United States Patent [19]

Testa

[11] 4,424,768

[45] Jan. 10, 1984

[54] HIGH TURBULENCE BOILER

[76] Inventor: Luigi Testa, 17014 Cairo Montenotte, Via XXV Aprile, 14, Savona, Italy

[21] Appl. No.: 345,482

[22] Filed: Feb. 3, 1982

Related U.S. Application Data

[63] Continuation-in-part of Ser. No. 144,541, Apr. 28, 1980, abandoned.

[30] Foreign Application Priority Data

May 8, 1979 [IT] Italy ..... 12584 A/79
Nov. 2, 1979 [IT] Italy ..... 27012 A/79

[51] Int. Cl.[3] ..... F22B 5/00

[52] U.S. Cl. ..... 122/16; 122/14; 122/17; 122/19; 126/361

[58] Field of Search ..... 122/13 R, 14, 19, 16, 122/17, 23; 126/361, 350 R

[56] References Cited

U.S. PATENT DOCUMENTS

| | | | |
|---|---|---|---|
| 54,730 | 5/1886 | Howell | 122/160 |
| 858,562 | 7/1907 | Bilhorn | 122/166 |
| 1,365,608 | 1/1921 | Trumble | 122/160 |
| 1,512,480 | 10/1924 | Palmblade | 122/18 |
| 1,891,534 | 12/1932 | Gray | 122/19 |
| 2,068,441 | 1/1937 | Valjean | 122/115 |
| 2,506,336 | 5/1950 | Block | 122/14 |
| 2,536,425 | 1/1951 | Daly | 122/166 R |
| 2,834,323 | 5/1958 | Radford | 122/114 |

*Primary Examiner*—Edward G. Favors
*Attorney, Agent, or Firm*—Steinberg & Raskin

[57] ABSTRACT

A boiler has a combustion chamber wherein combustion occurs under high turbulence and wherein the combustion products in the form of smoke are exhausted from the boiler in proximity to the liquid to be heated in a manner whereby the risk of the smoke path being clogged by soot is eliminated so that pollution of the ambient atmosphere is negligible. The burner-operated boiler has a combustion chamber which, at least in front of the burner, is defined by a concave wall section having its concavity facing the burner. In this manner, a recirculation of a portion of the smoke is obtained in the combustion chamber creating a high turbulent condition thereby facilitating complete combustion. The smoke is discharged from the combustion chamber into a smoke sleeve have a substantially annular shape with a vertical axis wherein the only horizontal wall on which deposition of soot may occur is very small. In certain embodiments, at least one vertical smoke conduit is provided through which smoke is directed from the combustion chamber and from which the smoke exits into the smoke sleeve to combine with the smoke which had directly entered into the latter from the combustion chamber. Any soot deposited in the vertical smoke conduits will return to the underlying combustion chamber.

15 Claims, 16 Drawing Figures

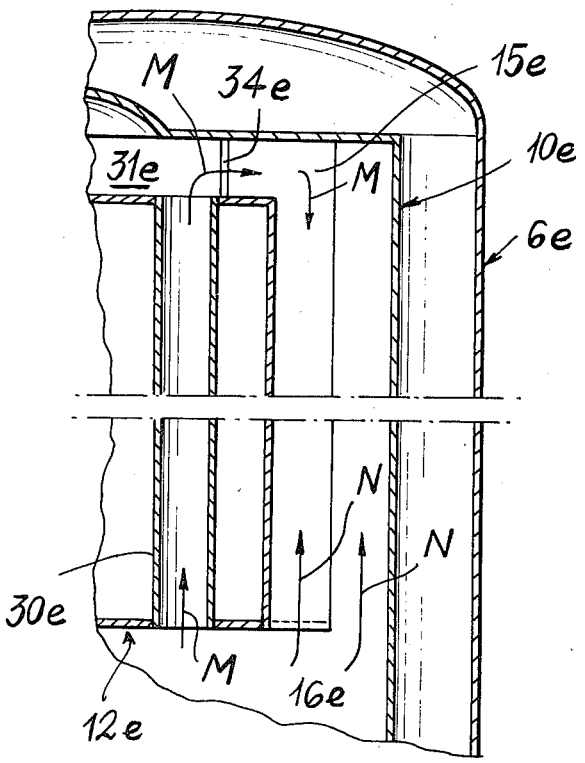
Fig. 11
Fig. 12
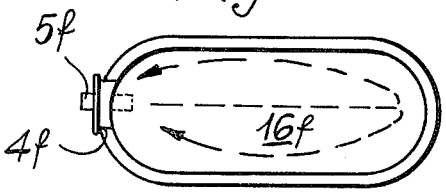

HIGH TURBULENCE BOILER

BACKGROUND OF THE INVENTION

This is a continuation-in-part of application Ser. No. 144,541 filed Apr. 28, 1980 abandoned.

The present invention relates to a heating boiler comprising a burner, a combustion chamber and at least one smoke path along which the combustion products in the form of smoke yield heat to water to be heated.

Conventional boilers of the prior art generally include a combustion chamber surrounded by a water jacket adapted to contain water to be heated. The combustion products in the form of smoke exit from the combustion chamber and are directed to a smoke box from which a horizontal nest of tubes extend. The tubes open into a second smoke box from which the smoke is directly conveyed to the chimney or stack. Alternatively, the smoke may be directed to the chimney indirectly through a second horizontal tube nest through which the smoke flows in the opposite direction.

The smoke boxes of conventional boilers as described above are generally provided with doors for cleaning the smoke tubes. However, even when these doors are insulated, large amounts of heat will be lost through them to the room in which the boiler is installed. Furthermore, the horizontal arrangement of the smoke tubes, which tubes generally have a relatively reduced cross-section, will allow a spontaneous deposition of soot onto the inner walls thereof thereby requiring frequent cleaning in order to avoid obstructions therein as well as the building up of deposits which will impair the efficiency of the heat transfer.

SUMMARY OF THE INVENTION

The principle object of the present invention is to provide a new and improved boiler wherein the soot deposits from the smoke are minimized. This object is accomplished by providing that the path followed by the smoke will present horizontal surfaces which are significantly reduced in area so that any soot deposits which do occur will not affect the efficiency of the heat transfer within the boiler.

Another object of the present invention is to provide a new and improved boiler which is devoid of smoke boxes and which therefore do not have heat losses related thereto, and wherein any unnecesary heat dispersions are eliminated, thereby resulting in a more efficient utilization of the heat generated during combustion.

Still another object of the present invention is to provide a new and improved boiler which is capable of attaining an optimum combustion in the combustion chamber with resulting minimization of ambient polution even where low-quality liquid fuel is utilized.

Briefly, these and other objects are attained by providing a burner-operated boiler including a combustion chamber and a smoke path along which the smoke yields heat to water to be heated. According to the invention, the combustion chamber is defined by a wall having a section which is concave and whose concavity faces the burner to obtain a recirculation of a portion of the smoke in the combustion chamber creating high turbulence conditions and, therefore, higher efficiencies. According to the invention, the path over which the combustion products or smoke is directed comprises at least one substantially annular vertical smoke sleeve. Moreover, according to another inventive feature of the invention, the smoke path may also include at least one vertical smoke conduit in addition to the smoke sleeve mentioned above. This feature is useful, for example, in boilers having a high thermal capacity, e.g., higher than 30,000 CAL/h. These smoke conduits extend vertically over the combustion chamber so that any soot tending to adhere thereto will eventually fall under its own weight into the combustion chamber below. The smoke exiting from the smoke conduit or conduits will combine with the smoke which had entered the smoke sleeve directly from the combustion chamber.

In a preferred embodiment of the invention, the combustion chamber may be of cylindrical, elliptical or semi-cylindrical shape having a vertical axis so that the burner flame will be directed horizontally against the concavity of the wall section to obtain the recirculation of combustion products back towards the burner along the wall of the combustion chamber and, additionally, incountercurrent to the flame.

In a preferred embodiment of the invention, the annular smoke sleeve is surrounded by water on three of its sides, i.e., on its inner and outer sides and on its top horizontal side. An interrupted annular partition is situated at the horizontal lower side of the smoke sleeve and defines the smoke sleeve in the direction of the combustion chamber, the interruption in the partition constituting the inlet into the smoke sleeve from which the smoke in the combustion chamber directly enters into the smoke sleeve. A substantially vertical partition member is located within the smoke sleeve and functions both to direct the smoke from the combustion chamber into the smoke sleeve, and to direct the smoke from within the smoke sleeve to the stack or chimney.

In a preferred embodiment of the invention, a vessel member is situated within the boiler which serves to partially define the smoke sleeve. Moreover, the boiler is provided with a water jacket which extends over the sides, the bottom and the top of the boiler and fluidly communicates with the vessel member defining the smoke sleeve.

According to another inventive feature of the invention, the vessel member may be fluidly connected at its bottom with the water jacket by means of a conduit which extends in the combustion chamber and which is preferably located in the vertical plane of the burner flame.

Additionally, in the case of high heat capacity boilers, a plurality of vertically extending smoke conduits extend through the vessel member and communicate at their bottom ends with the combustion chamber. A smoke chamber is provided vertically over the vessel member which communicates with the smoke sleeve and the smoke conduits open at their upper ends into the smoke chamber. In this manner, the smoke flowing through the smoke conduits is directed into the smoke sleeve through the smoke chamber whereupon it is conveyed to the stack which is preferably located towards the lower part of the smoke sleeve.

In an illustrated preferred embodiment, the boiler includes an inner shell having a substantially vertical side wall, the lower portion of the inner shell constituting the combustion chamber. An open-top vessel member is situated within an upper portion of the inner shell and is adapted to receive a liquid to be heated. The vessel member has a bottom wall and a substantially vertical side wall which is spaced inwardly from an upper region of the inner shell side thereby defining therewith a substantially annular smoke sleeve. The boiler includes an outer shell which surrounds the inner shell and has a substantially vertical side wall which is spaced outwardly from the inner shell side wall to define a sleeve-like space therebetween which constitutes a water jacket which at least partially surrounds the combustion chamber and the smoke sleeve. The water jacket is in fluid communication with the vessel member. A smoke discharge conduit passes through the outer shell and opens into the smoke sleeve at a discharge opening formed in the inner shell. A partition is situated within the smoke sleeve proximate to the smoke discharge opening and extends substantially vertically over the substantial height of the vessel member between the side walls of the inner shell and vessel member. During operation of the boiler, the smoke produced in the combustion chamber passes directly into the smoke sleeve surrounding the vessel member and travels in a helicoidal path around the vessel member and exits from the smoke sleeve throught the discharge opening.

The outer shell may include a top wall which closes the same in a manner such that air is confined within the outer shell which will be situated over the level of liquid within the water jacket and vessel member so that the outer shell can function as a pressurized expansion tank.

A service liquid heating vessel may be situated within the vessel member in a manner so as to be immersed within the liquid to be heated which is received within the vessel member. Moreover, a plurality of substantially vertically extending water tubes may be situated around the combustion chamber and extend through the smoke sleeve.

A smoke chamber is provided vertically over the vessel member, the smoke chamber being in fluid communication with the smoke sleeve. A plurality of smoke conduits are provided, each smoke conduit passing in a substantially vertical direction through the vessel member and having upper and lower ends opening into the combustion chamber and smoke chamber, respectively. During operation of the boiler, the smoke produced in the combustion chamber passes through the smoke conduits into the smoke chamber above the vessel member and then into the smoke sleeve where it combines with the smoke which had entered into the smoke sleeve directly from the combustion chamber.

The water jacket in this embodiment has a portion which is situated vertically over the smoke chamber and a tube section is provided having upper and lower ends which open into the inner shell top wall and the upper portion of the water jacket to provide fluid communication between the vessel member and the water jacket.

The actual shape of the annular smoke sleeve may vary and in one embodiment the horizontal cross-section of the smoke sleeve varies which improves the functional characteristics of the boiler.

DESCRIPTION OF THE DRAWINGS

A more complete appreciation of the invention and many of the attendant advantages thereof will be readily appreciated as the same becomes better understood by reference to the following detailed description when considered in connection with the accompanying drawings in which:

FIG. 11 is a fragmentary sectional view taken along line XI—XI of FIG. 10 and illustrated on a larger scale;

FIG. 12 is a diagramatic cross-sectional view at the level of the combustion chamber of a boiler according to the present invention having an elongated configuration and semi-circular ends;

DESCRIPTION OF THE PREFERRED EMBODIMENTS

Figure 1:
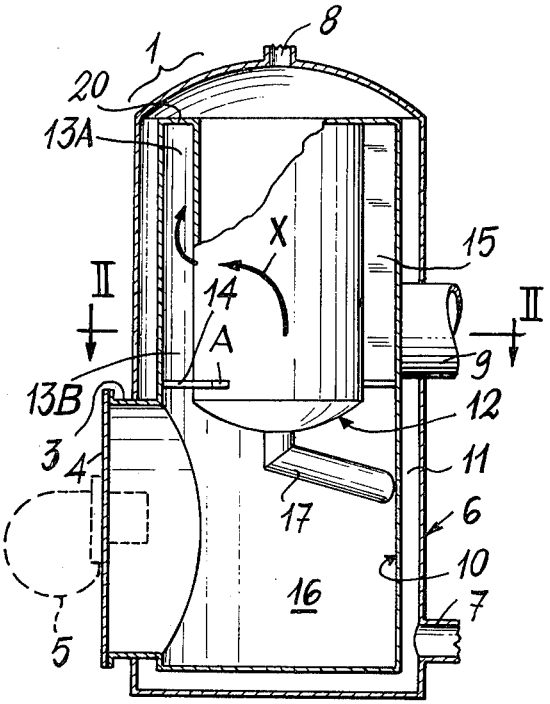
FIG. 1 is a side elevation view in section of a first embodiment of a boiler according to the present invention and constituting a sectional view taken along line I—I of FIG. 2.
Figure 1A:
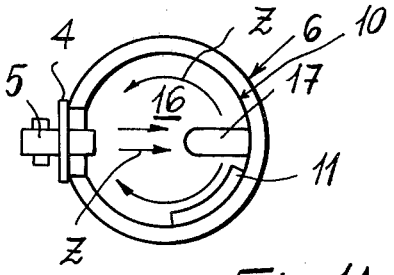
FIG. 1A is a schematic horizontal sectional view of the boiler illustrated in FIG. 1 illustrating the combustion chamber.
Figure 2:
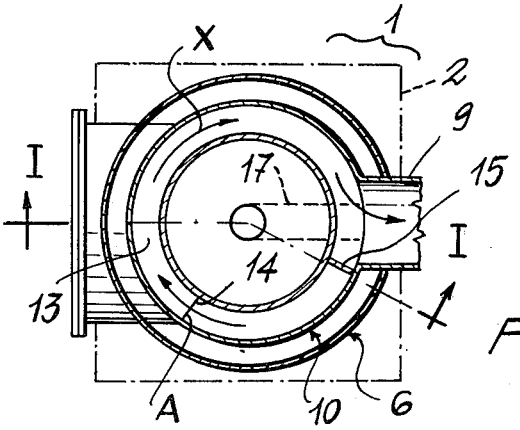
FIG. 2 is a sectional view taken along line II—II of FIG. 1.

Referring now to the drawings wherein like reference characters and associated letter suffixes designate corresponding components of the several embodiments, and more particularly to FIGS. 1, 1A and 2, a boiler 1 is illustrated of the low heat capacity type and which is generally suitable for a heating system. A suitably insulated shell 2 preferably surrounds the boiler except at an inlet 3 where a plate 4 is provided. The plate 4 supports a burner 5 of any conventional construction in a known manner.

Boiler 1 comprises an outer housing, envelope or shell 6, preferably formed of sheet-iron and having a substantially cylindrical shape. The longitudinal axis of outer shell 6 extends substantially vertically. The burner 5 is supported by plate 4 so that the axis of the flame produced by the burner is substantially at right angles to the axis of the outer shell 6. An inlet 7 is provided at the bottom of outer shell 6 through which the return water from the heating system enters into the boiler. The heated water exits from an outlet opening 8 located at the top of the outer shell 6.

A smoke discharge pipe passes through the outer shell 6 and communicates with a smoke sleeve, described below. The smoke is discharged from the boiler through the smoke discharge pipe 9 and is conveyed therefrom to the stack or chimney (not shown).

The boiler further includes an inner housing, envelope or shell 10, also preferably formed of sheet-iron in a substantially cylindrical shape. Outer and inner shells 6 and 10 have substantially vertical side walls which are spaced from each other to define a sleeve-like space therebetween constituting a water jacket 11. In the illustrated embodiment, the water jacket 11 extends over the entire boiler except, of course, for the zone where plate 4 is located. Thus, the water jacket 11 extends over the bottom, sides and top of the boiler.

An open-top vessel member 12 is situated within an upper portion of the inner shell 10. The vessel member 12 has a substantially cylindrical shape and is preferably formed of any suitable metal. The open top of vessel member 12 fluidly communicates with the upper portion of water jacket 11.

The vessel member 12 has a bottom wall and a substantially vertical side wall, the latter being spaced inwardly from an upper region of the inner shell side wall thereby defining a substantially annular smoke sleeve 13 therewith. The annular smoke sleeve 13 is illustrated in FIG. 1 as constituting an upper zone 13A and a lower zone 13B.

A ring-shaped interrupted partition 14 defines the lower side of the smoke sleeve 13. More particularly, the ring-shaped partition 14 extends around a major portion of the periphery of the vessel member 12 and between the side walls of the inner shell 10 and the vessel member 12. The interruption of partition 14 constitutes an aperture formed therein and extends from an edge A thereof to a substantially vertically extending partition 15. The vertical partition 15 is situated in the smoke sleeve 13 over the substantial height of the vessel member 12 and between the side walls of the inner shell 10 and the vessel member 12. The vertical partition 15 is located proximate to the smoke discharge pipe 9 opening into smoke sleeve 13.

It is seen from the above that the smoke or combustion products generated in combustion chamber 16 will move directly through the interruption in the horizontal ring-shaped partition 14 into the smoke sleeve 13 and move in a helicoidal path as shown by arrows X and upon encountering the obstruction provided by the vertical partition 15 will be directed into the smoke pipe 9 and from there into the stack or chimney (not shown).

The open-top vessel member 12 is connected at its bottom to the water jacket 11 by means of an inclined connector conduit 17 which is substantially located in the vertical median plane of the burner so that it may act as a flame baffle.

As shown in FIG. 1A, at a location directly opposed to burner 5, the combustion chamber 16 is defined by a wall section constituted by a section of the cylindrical inner shell 10 in a manner such that the concavity of that wall section faces burner 5. In this manner, a circulation of the smoke or combustion products shown by arrows Z occurs within the combustion chamber. This circulation is a countercurrent overturned flame operation with three flame flues, namely one central and two side flues. In this manner, a high efficiency is obtained due to the resulting recirculation of a portion of the smoke which is mixed under a strong turbulent condition.

It will be readily understood from the above that smoke sleeve 13 is defined by two vertical surfaces, i.e., the opposed side wall portion of inner shell 6 and vessel member 12. Moreover, an upper horizontal surface 20 interconnects the upper edge regions of the inner shell 6 and vessel member 12. Thus, the upper horizontal surface 20 constitutes the upper side of smoke sleeve 13 while the ring-shaped partition 14 constitutes its lower side. There can be no deposition of soot on the side and top wall surfaces of smoke chamber 13 and although a deposition of soot may occur on the horizontal partition 14, since the passage area of the smoke sleeve is relatively large, the loss of heat transfer efficiency resulting from such deposition of soot will be negligible. Since the soot deposit will not significantly affect the behavior of the boiler, it can be removed after relatively long periods of operation of the boiler.

It should be noted that due to the particular construction of the smoke sleeve 13 described above, any soot deposits forming therein may be removed in an easy manner by merely introducing ordinary cleaning tools through the smoke discharge pipe 9 and withdrawing the same through the door 4 after the soot has fallen into the combustion chamber 16 through the interruption of the horizontal partition 14.

When the water jacket 11 is filled with liquid to be heated, it is seen that the smoke sleeve 13 is surrounded on three sides by such liquid, namely on its inner side defined by a side wall of vessel member 12, its outer side defined by a side wall of inner shell 10 and its top side defind by plate 20.

The embodiments illustrated in FIGS. 3 and 4 will now be described and for purposes of simplicity, components thereof corresponding to similar components of the embodiment illustrated in FIG. 1 will be designated by the same reference numerals followed by the suffixes "a" "b", respectively.

Figure 3:
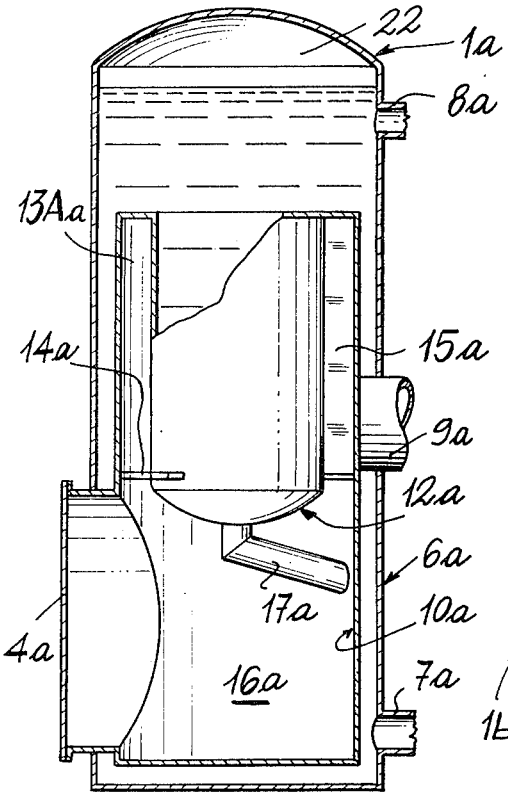
FIG. 3 is an elevation view in section of a second embodiment of a boiler according to the present invention which includes a pressurized expansion tank.

The boiler 1A illustrated in FIG. 3 differs from that of FIG. 1 in that the hot water outlet 8A is located on the side wall of outer shell *6a* rather than on its top wall and in that the outer shell 6 terminates at its top in a closed dome 22. With this construction, the space located above the level of water in the boiler is confined therein and is effective as a pressurized expansion tank for the heating system in which the boiler is installed.

Figure 4:
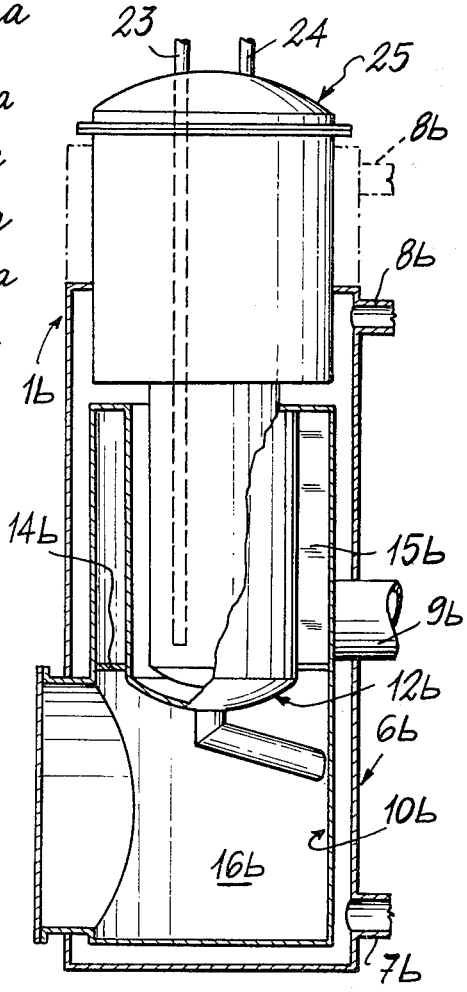
FIG. 4 is an elevation view partly in section of a third embodiment of a boiler according to the present invention including a service water heater.

Referring to the boiler *1b* illustrated in FIG. 4, this boilr differs from that illustrated in FIG. 1 in that a heater 25 is provided for heating service water, e.g., water intended to be dispensed in a building or apartment in which the boiler is installed. The heater 25, which is provided with a water inlet 23 and a water outlet 24, is preferably formed in two cylindrical sections having different diameters, the smaller diameter lower section being immersed in the vessel member 12B while the larger diameter upper section of which is partly or almost completely immersed in the water situated at the top of the boiler.

Figure 5:
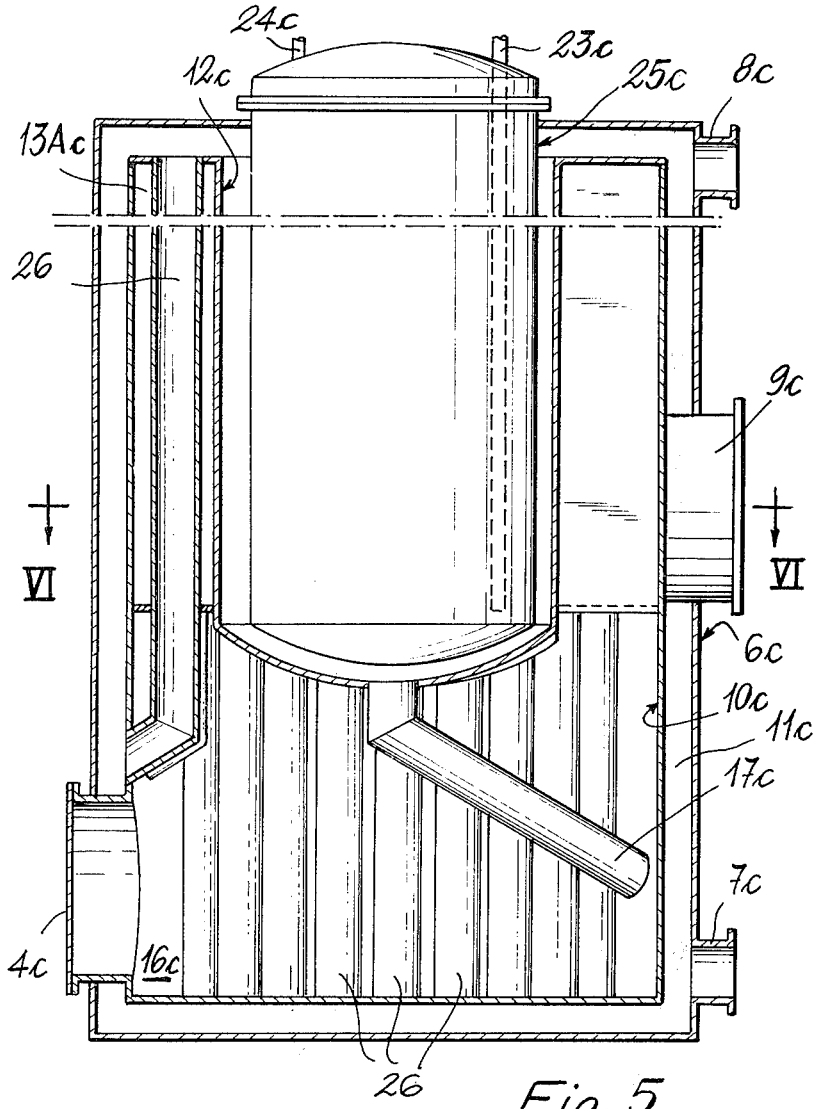
FIG. 5 is an elevation view partly in section of a fourth embodiment of a boiler according to the present invention also including provisions for service water heating.
Figure 6:
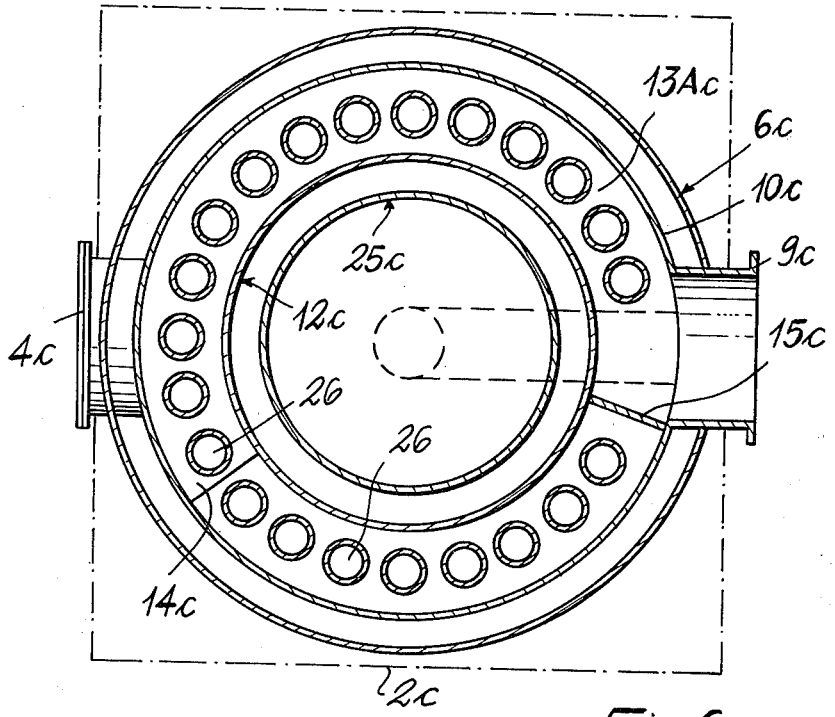
FIG. 6 is a sectional view taken line VI—VI of FIG. 5.

Referring now to FIGS. 5 and 6, another embodiment of a boiler according to the present invention is illustrated and components thereof which correspond to components found in the embodiment illustrated in FIG. 1 are designated by the same reference numeral followed by the suffix "c". The boiler illustrated in FIGS. 5 and 6 is essentially constructed according to the same principles as the boilers discussed above and is provided with a heater *25c* for heating service water. The only significant difference from the previously described embodiments is the provision of a ring of substantially vertically extending water tubes 26 which, with the exception of those water tubes which would otherwise pass in front of the burner supporting plate 4c, extend from the lower ends of the inner shell 10c through the smoke sleeve 13Ac. Thus, the lower ends of water tubes 26 surround the combustion chamber 16C while the upper ends extend through the smoke sleeve 13Ac. Although the vertical partition 15c is illustrated in FIG. 6, a water tube 26 having a larger cross-section may be substituted therefor so as to completely occupy and obstruct the section of the smoke sleeve 13Ac adjacent to the smoke discharge pipe 9c.

The embodiments of the boilers illustrated in FIGS. 7–15 are intended for heating systems having higher thermal requirements. In these embodiments, a plurality of vertically extending smoke conduits 30 are provided which are associated with the smoke sleeve 13A to increase the heat transfer from the smoke to the liquid to be heated.

Figure 8:
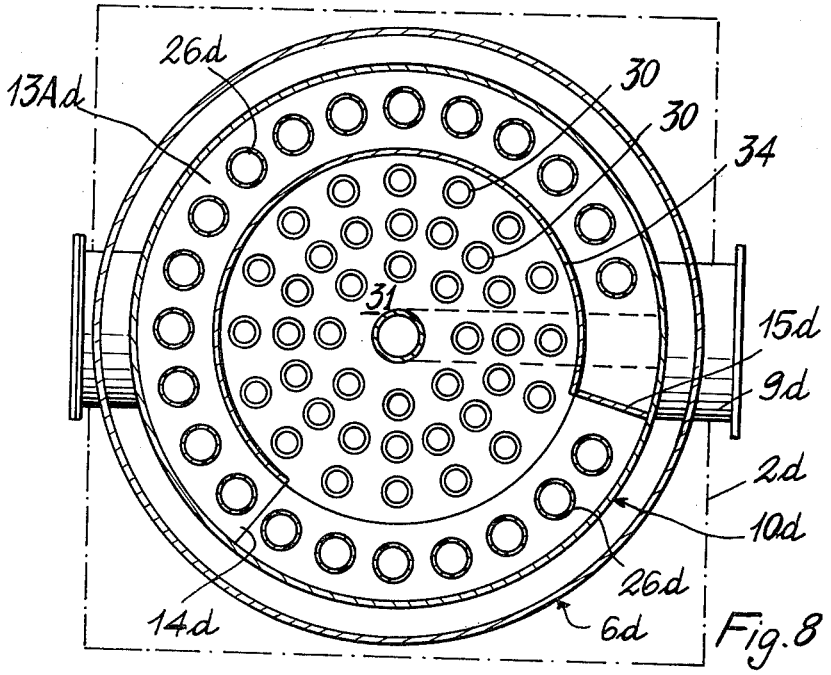
FIG. 8 is a section view taken along line VIII—VIII of FIG. 7.
Figure 7:
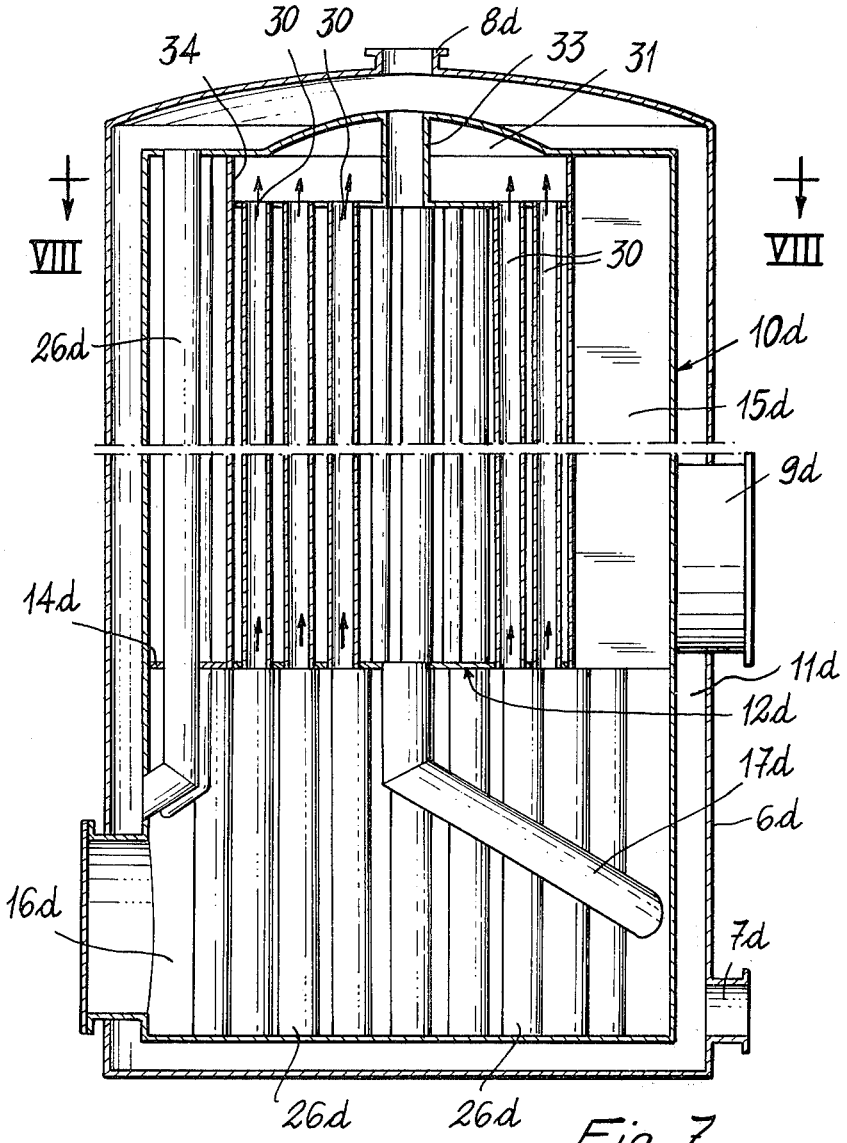
FIG. 7 is an elevation view in section of a fifth embodiment of a boiler according to the present invention.

Referring to the embodiment of the boiler illustrated in FIGS. 7 and 8 whose components which correspond to similar components of the previously discussed embodiments designated by the same reference numerals followed by the suffix "d", a nest of vertical smoke tubes 30 extend through the vessel member 12D, the lower ends of smoke conduits 30 opening into the combustion chamber 16D. It is noted that soot cannot become deposited in the smoke conduits 30 since any such deposits would fall under gravity into the underlying combustion chamber.

A smoke collector chamber 31 is formed over the vessel member 12D and the open upper ends of smoke conduits 30 open into the smoke collector chamber 31. The smoke collector chamber 31 is defined by a dome-shaped portion of a top of the inner shell 10D and a plate 32 which closes the top of the vessel member 12D, except for those portions constituting the open ends of smoke conduits 30. Moreover, a tube section 33 has ends which open into the interior of vessel member 12D and the dome-shaped top of inner shell 10D so as to provide fluid communication between the vessel member 12D and water jacket 11D. The chamber 31 is laterally defined by an interrupted ring partition 34 which may constitute an extension of the side wall of vessel member 12D. The interruption in the ring partition 34 (see also FIG. 15) allows for fluid communication between the collector chamber 31 and the upper end region of smoke sleeve 13Ad and is preferably formed so that an edge thereof coincides with the horizontal partition 14d.

It is seen from the above that the smoke which enters into the lower ends of smoke conduits 30 will pass therethrough in proximity to the liquid contained within vessel member 12d and exit into the smoke collector chamber 31 from which the smoke will pass through the interruption in the ring partition 34 into the smoke sleeve 13Ad where it will mix with the smoke located therein which had entered directly from the combustion chamber 16d. The combined smoke will then move through the smoke sleeve 13Ad and upon being diverted by the vertical partition 15d will be discharged through the smoke discharge pipe 9d into the stack or chimney.

Turning now to FIGS. 9–11 and 13–15, another embodiment of a boiler according to the present invention as illustrated and components thereof which correspond to components of embodiments discussed above will be designated by the same reference numeral followed by the suffix "e".

Figure 10:
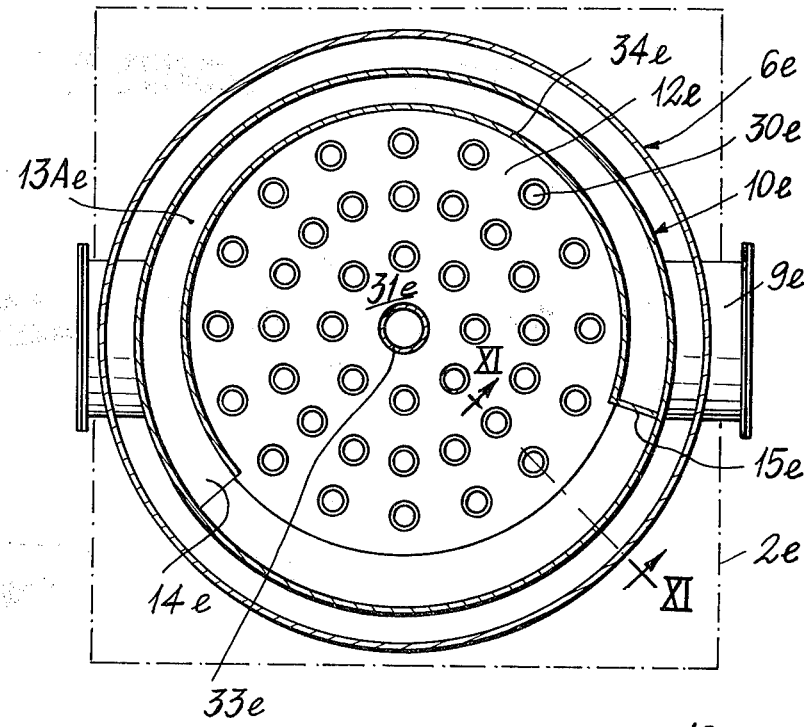
FIG. 10 is a sectional view taken along line X—X of FIG. 9.
Figure 13:
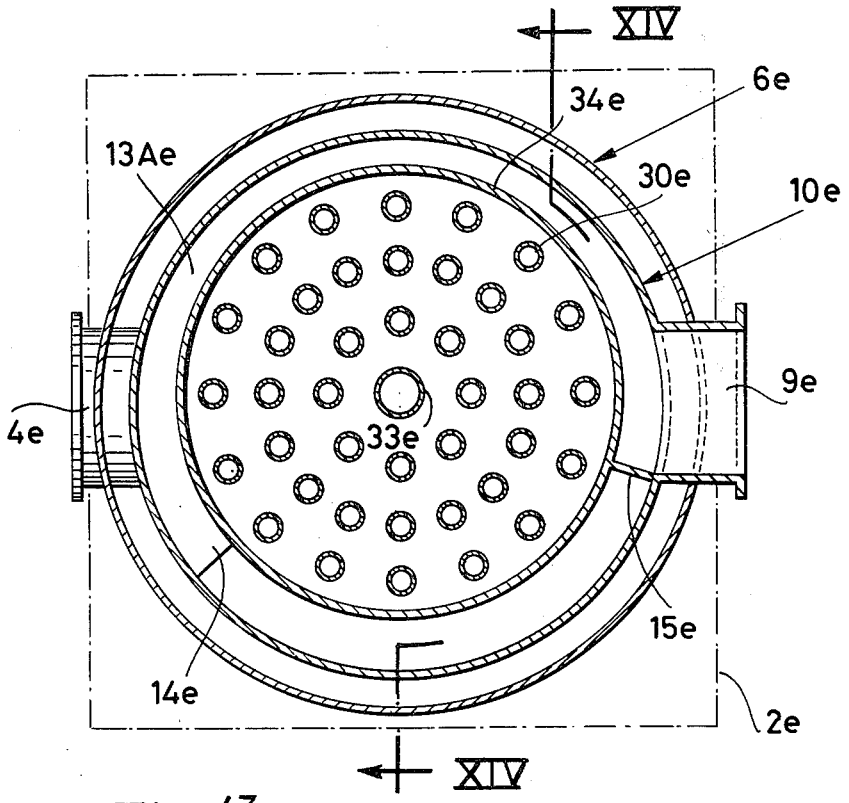
FIG. 13 is a sectional view taken along line XIII—XIII of FIG. 9.
Figure 14:
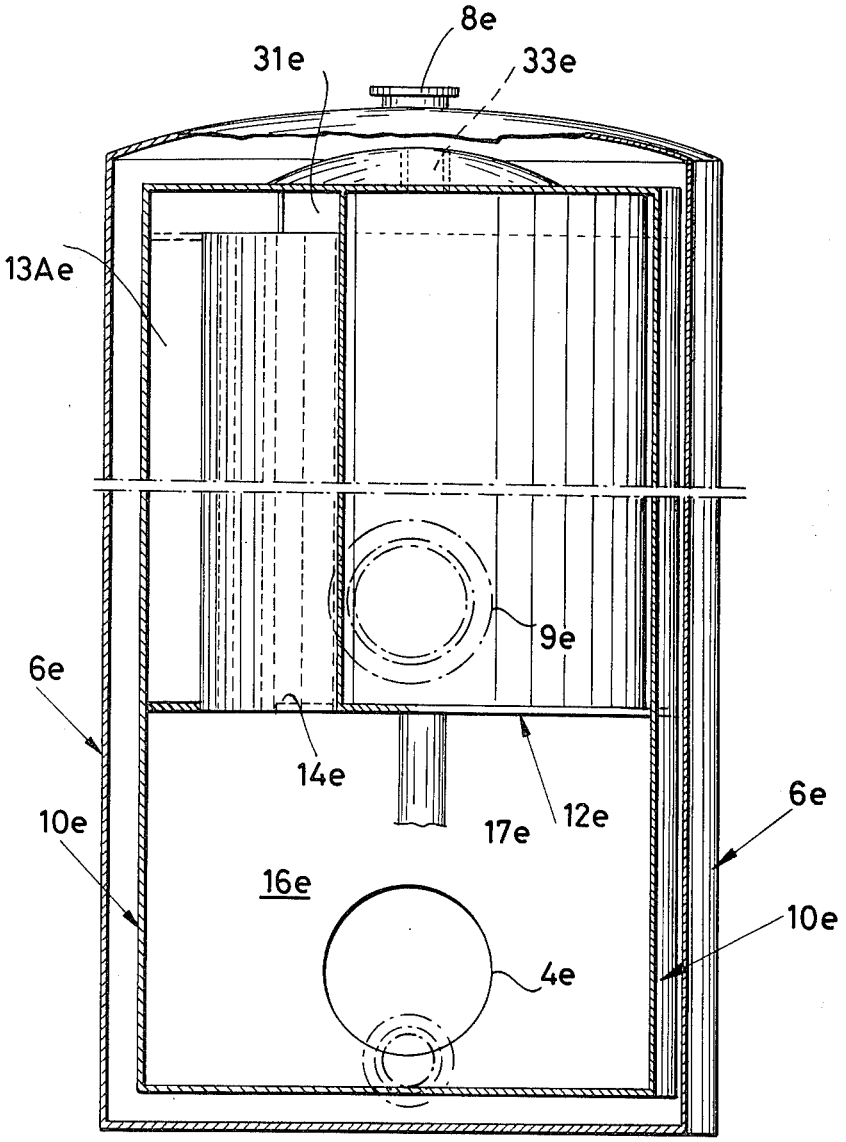
FIG. 14 is a sectional view taken along line XIV—XIV of FIG. 13.

The boiler illustrated in these figures in somewhat analogous to that illustrated in FIGS. 7 and 8 but differs therefrom in the following two aspects: (a) the smoke discharge pipe 9e is located more closely to the horizontal partition 14e thereby permitting, for example, a more convenient cleaning of the upper face of the horizontal partition, and (b) the smoke sleeve 13Ae narrows and then becomes wider in a progressive manner from the inlet (the interruption in partition 14e) to the outlet (disc smoke discharge pipe 9e) thereof. This may be easily accomplished by arranging the vessel member 12e in an eccentric manner relative to the inner shell 10e of the boiler as best seen in FIG. 10.

Figure 9:
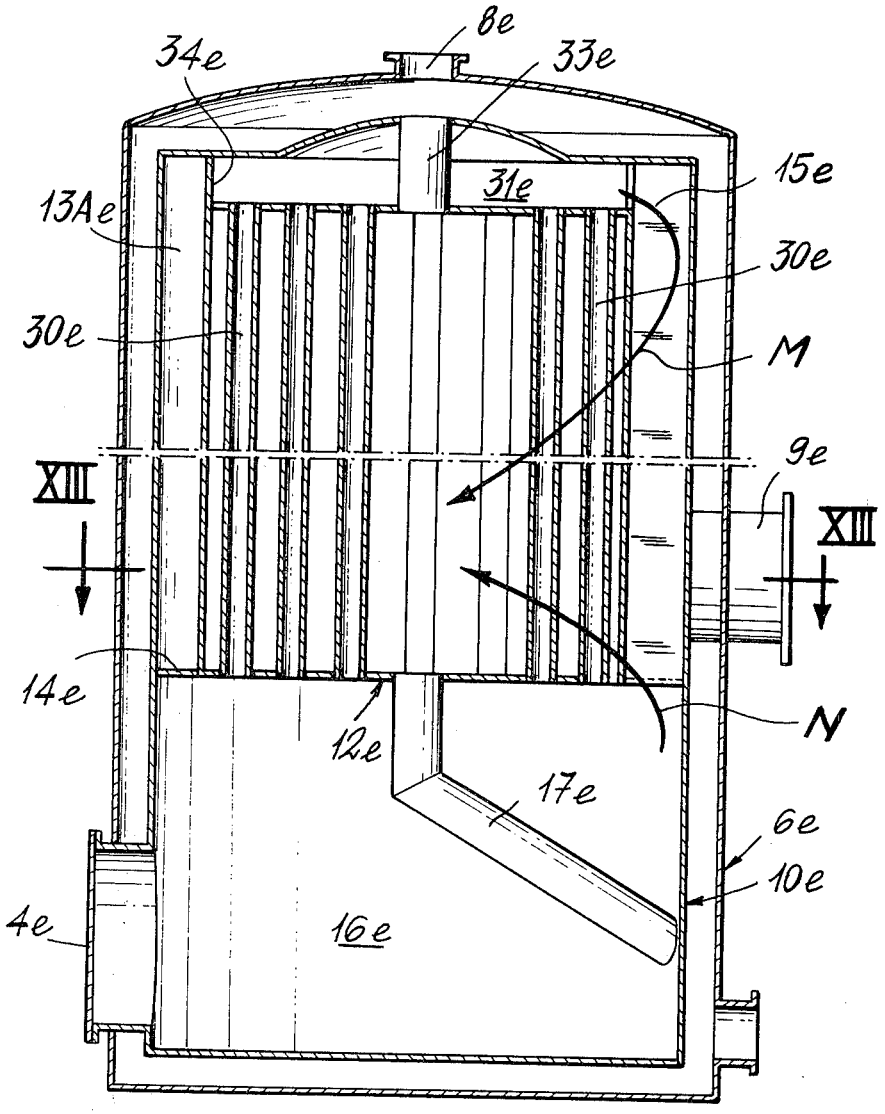
FIG. 9 is an elevation view in section of a sixth embodiment of a boiler according to the present invention.
Figure 15:
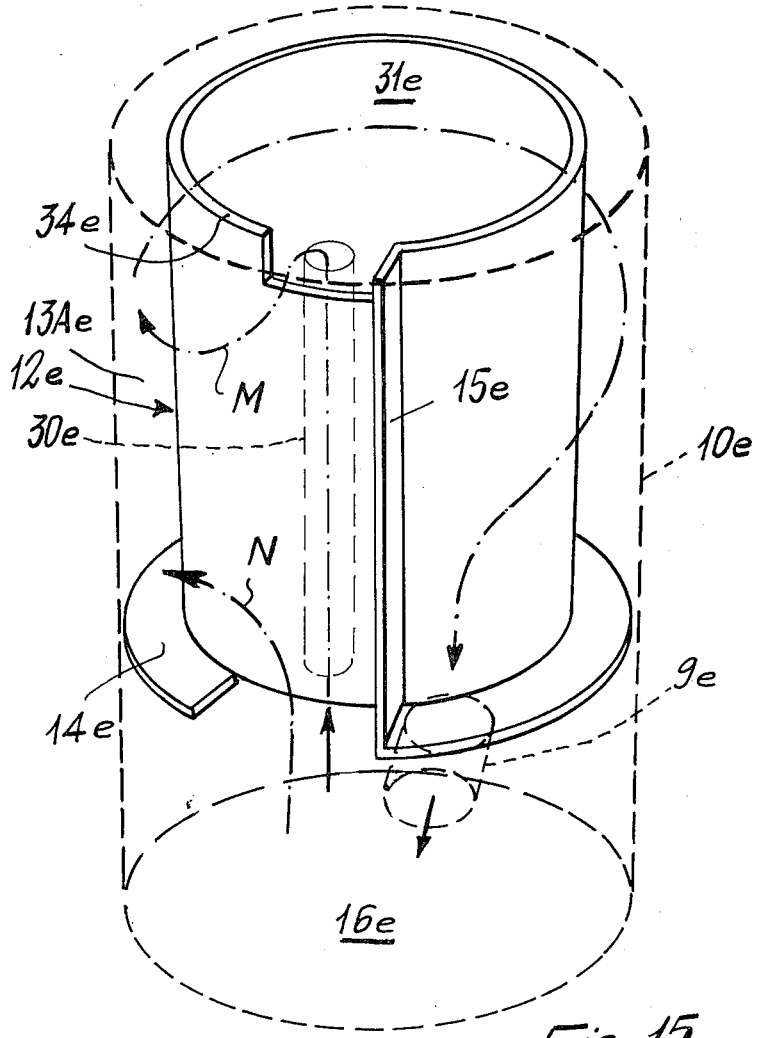
FIG. 15 is a schematic perspective view illustrating the smoke sleeve and associated components and the path of travel of the smoke which exits in the embodiment of the boiler illustrated in FIG. 9.

The above mentioned features of the boiler act to improve the functional characteristics thereof. Referring in particular to FIGS. 9, 11 and 15, a portion of the smoke generated in combustion chamber 16e directly enters into the smoke sleeve 13Ae through the interruption in the ring-shaped partition 14e and is designated by arrow N. The remaining portion of the smoke generated in combustion chamber 16e enters into the smoke conduits 30e from which the smoke exits into the smoke collector chamber 31e. On reaching the collecting chamber 31E, this portion of the smoke, designated by arrow M is exhausted through the interruption in partition 34e into the smoke sleeve 13Ae where it joins and combines with the smoke which had entered directly into the smoke sleeve from combustion chamber 16E, designated by arrow N. Subsequent to mixing, the combined smoke flows within the smoke sleeve 13Ae in a helicoidal path (best seen in FIG. 15) and is diverted by vertical partition 15e through the smoke discharge pipe 9e.

In the embodiments of the invention illustrated in FIGS. 7–11 and 13–15, the smoke conduits 30 are illustrated in the form of tubular sections. However, it is understood that it is within the scope of the present invention to provide the smoke conduit with different configurations than that shown. For example, the smoke conduits may be in the form of vertical passages having substantially annular cross sections, preferably mutually concentric. The annular vertical passages may alternate with annular water jackets or passages. For example, the water jackets which preferably comprise bodies formed of pig iron, will be mutually superimposable and assembleable over each other. The water jackets or passages will be hydraulically interconnected by tubes or conduits integrally formed by the annular walls defining the water and smoke passages. The tubes or conduits will also mechanically connect the annular walls.

Finally, referring to FIG. 12, it is seen that the combustion chamber 16f may be formed with an elongated shape having inward concave ends. In this manner, the counter current overturned flame circulation described above can be obtained as illustrated by the arrows illustrated in this figure.

Obviously, numerous modifications and variations of the present invention are possible in the light of the above teachings. It is therefore to be understood that within the scope of the claims appended hereto the invention may be practiced otherwise than as specifically disclosed herein.

What is claimed is:

1. A boiler, comprising:

an inner shell having a substantially vertical side wall and wherein a lower portion of said inner shell constitutes a combustion chamber;

an open-top vessel member situated within an upper portion of said inner shell and adapted to receive a liquid to be heated, said vessel member having a bottom wall and a substantially vertical side wall which is spaced inwardly from an upper region of said inner shell side wall defining a substantially annular smoke sleeve therebetween;

an outer shell surrounding said inner shell and having a substantially vertical side wall which is spaced outwardly from said inner shell side wall to define a sleeve-like space therebetween constituting a water jacket which at least partially surrounds said combustion chamber and said smoke sleeve and which is in fluid communication with said vessel member;

a smoke discharge conduit passing through said outer shell and opening into said smoke sleeve at a discharge opening formed in said inner shell;

partition means situated in said smoke sleeve extending substantially vertically over the substantial height of said vessel member and between said side walls of said inner shell and vessel member, said partition means being located proximate to said smoke discharge opening;

whereby smoke produced in said combustion chamber during operation of said boiler passes directly into said smoke sleeve surrounding said vessel member and travels in a helicoidal path around said vessel member and exits from said smoke sleeve through said discharge opening.

2. The combination of claim 1 further including second partition means extending around at least the major portion of the periphery of said vessel member and between said side walls of said inner shell and vessel member, said second partition means having an aperture formed therein such that said smoke sleeve communicates with said combustion chamber through said aperture, whereby the smoke produced in said combustion chamber passes directly through said smoke sleeve through said aperture of said second partition means.

3. The combination of claim 1 wherein upper edge regions of said side walls of said vessel member and inner sleeve are interconnected by a wall member defining the upper side of said smoke sleeve, whereby said smoke sleeve is adapted to be surrounded by water on three sides thereof including its outer side constituted by said inner shell side wall, its inner side constituted by said vessel member side wall and said upper side thereof.

4. The combination of claim 3 wherein said outer shell has a top wall which closes the same whereby air is confined within said outer shell situated over the level of liquid within said water jacket and vessel member so that said outer shell can function as a pressurized expansion tank.

5. The combination of claim 1 further including a service liquid heating vessel situated within said vessel member adapted to be immersed within the liquid to be heated received therein.

6. The combination of claim 1 further including a plurality of substantially vertically extending water tubes situated around said combustion chamber and extending through said smoke sleeve.

7. The combination of claim 1 wherein a smoke chamber is provided vertically over said vessel member, said smoke chamber being in fluid communication with said smoke sleeve, and further including a plurality of smoke conduits, each smoke conduit passing in a substantially vertical direction through said vessel member and having upper and lower ends opening into said combustion chamber and smoke chamber respectively, whereby smoke produced in said combustion chamber during operation of said boiler passes through said smoke conduits into said smoke chamber and then into said smoke sleeve wherein it combines with the smoke which entered into said smoke sleeve directly from said combustion chamber.

8. The combination of claim 7 wherein said smoke chamber is defined by a plate member overlying said vessel member except in the areas on which said upper ends of said smoke tubes open, a top wall of said inner shell, and a ring-shaped partition extending between said plate member and inner shell top wall, and wherein an aperture is formed in said ring-shaped partition to provide fluid communication between said smoke chamber and smoke sleeve.

9. The combination of claim 8 further including a tube section having upper and lower ends opening into said inner shell top wall and said plate member to provide fluid communication between said vessel member and said water jacket.

10. The combination of claim 1 wherein the spacing between said vessel member and inner shell side walls in a horizontal cross section of said smoke sleeve varies.

11. The combination of claim 1 wherein said combustion chamber constituted by a portion of inner shell is defined by a concave portion of said inner shell side wall and a burner facing the concavity of said inner shell side wall.

12. A boiler, comprising:

a combustion chamber defined by a side wall member at least a portion of which is concave, a burner situated in facing relationship with said concave wall portion, a smoke sleeve being constituted by inner and outer opposed side wall members defining a substantially annular space, said smoke sleeve at its lower end being in fluid communication with said combustion chamber, whereby smoke will enter directly into said smoke sleeve from said combustion chamber, and at least one substantially vertically extending smoke conduit having a lower end in fluid communication with said combustion chamber and its upper end in fluid communication with said smoke sleeve, whereby smoke entering into said smoke conduit at its lower end exits therefrom at its upper end and is directed into said smoke sleeve where it combines with the smoke therein which entered the smoke sleeve directly from said combustion chamber.

13. A boiler, comprising a combustion chamber defined by a side wall member at least a portion of which is concave, a burner situated in facing relationship with said concave wall portion, a smoke sleeve being constituted by inner and outer opposed side wall members defining a substantially annular space, said smoke sleeve at its lower end being in fluid communication with said combustion chamber, whereby smoke will enter directly into said smoke sleeve from said combustion chamber, and wherein the axis of said annular smoke sleeve extends substantially vertically and said inner and outer opposed side wall members constituting said smoke sleeve at least partially define volumes adapted to contain a liquid to be heated, whereby said smoke sleeve can be surrounded on its sides by liquid during operation of said boiler, and further including a ring-shaped interrupted partition defining the lower side of said smoke sleeve, the interruption in said ring-shape partition constituting an aperture through which smoke can enter into the smoke sleeve directly from the combustion chamber.

14. The combination of claim 13 further including a top wall of said smoke sleeve, said top wall at least partially defining a volume adapted to receive a liquid to be heated, whereby said smoke sleeve can be surrounded on its sides and at top by liquid during operation of said boiler.

15. The combination of claim 12 wherein partition means are situated in said smoke sleeve for directing smoke from said combustion chamber into said smoke sleeve and for directing the smoke from the smoke sleeve.

* * * * *